United States Patent [19]

Stegmeier

[11] Patent Number: 4,967,424

[45] Date of Patent: Nov. 6, 1990

[54] TRACK SUPPORT FOR A LINER TYPE IN-GROUND SWIMMING POOL

[76] Inventor: William J. Stegmeier, 3313 Ambassador Row, Arlington, Tex. 76013

[21] Appl. No.: 396,999

[22] Filed: Aug. 22, 1989

[51] Int. Cl.[5] ..... E04H 3/14

[52] U.S. Cl. ..... 4/496; 4/506; 160/395; 24/461; 24/462

[58] Field of Search ..... 4/506, 488, 496, 498, 4/503; 24/460, 461, 462; 160/395

[56] References Cited

U.S. PATENT DOCUMENTS

| | | | |
|---|---|---|---|
| 2,914,776 | 12/1959 | Hotz | 4/503 X |
| 3,347,006 | 10/1967 | Fox | 4/488 X |
| 3,628,198 | 12/1971 | Katzman | 4/496 X |
| 3,803,671 | 4/1974 | Stuppy et al. | 24/460 |
| 4,064,571 | 12/1977 | Phipps | 4/506 X |
| 4,107,826 | 8/1978 | Tysdal | 4/498 X |
| 4,158,244 | 6/1979 | Stefan | 4/506 X |
| 4,335,474 | 6/1982 | Bailey | 4/506 |
| 4,370,839 | 2/1983 | Blakeway | 4/506 X |
| 4,457,119 | 7/1984 | Dahowski | 52/300 |
| 4,574,017 | 3/1986 | Stegmeier | 156/60 |
| 4,601,073 | 7/1986 | Methot | 4/506 |
| 4,603,521 | 8/1986 | Englehart | 52/102 |
| 4,662,038 | 5/1987 | Walker | 24/460 |
| 4,713,849 | 12/1987 | Kindness | 4/506 X |

OTHER PUBLICATIONS

Quaker Plastic Corp., Catalogue SA-112, p. 10, and form OP-103-B2 (date unknown).

*Primary Examiner*—Ernest G. Cusick
*Assistant Examiner*—Robert M. Fetsuga
*Attorney, Agent, or Firm*—Daniel Rubin

[57] ABSTRACT

A track structure for retaining the liner of a liner type in-ground swimming pool is comprised of two component parts including an elongated length of a channel-like body section adapted to be secured about the perimeter of a liner-type pool and a channel-like insert adapted to be removably disposed within the body section. Both components are formed of polymeric plastic composition and both are configured at least partially complementary, so as to enable the insert to effect a snap-in interfit for securing the insert within the body. The insert when disposed within the body cooperates with an internal body surface wall to define a narrow clearance through which the liner can extend while securing the beaded edge of the liner against withdrawal. When the body and insert are assembled, a single exposed channel is provided, enabling a form board to be positioned thereat for the pouring and setting of aggregate deciking about the pool. Also disclosed is the use of an adhesive tape having a detergent-soluble gum for mounting the form board directly onto the surface of an in-place linear. On retrieving the form board, any gum residue on the liner can be removed with a detergent solution.

15 Claims, 2 Drawing Sheets

TRACK SUPPORT FOR A LINER TYPE IN-GROUND SWIMMING POOL

FIELD OF THE INVENTION

The field of art to which the invention relates comprises improvements for constructing a liner-type in-ground swimming pool about which an aggregate decking is to be formed.

BACKGROUND OF THE INVENTION

When constructing an in-ground-type swimming pool, the bowl is first excavated to a desired shape and depth. Where the bowl is to be comprised of a plastered wall, the wall and base of reinforced concrete is first poured and set in place before the plaster is applied. Utilizing a polystyrene concrete form board positioned upright, against and above the wall, an aggregate decking is poured and permitted to set about the pool perimeter.

Where the bowl excavation is to be lined with a sheet of beaded edge plastic liner material, it is common to provide a track secured to a panel about the pool perimeter. The track defines a continuous channel in which the beaded upper edge of the plastic liner can be retained. With a concrete form board secured upright of the track as above, aggregate decking can be formed about the pool perimeter similarily as with the concreted pool.

DESCRIPTION OF THE PRIOR ART

Following placement of a liner track for a liner-type in-ground swimming pool, the ensuing construction procedure can be subject to variation, depending on whether the water fill is to occur before or after the aggregate decking is poured and set. Where a single channel track is utilized and the water fill is to occur after formation of the poured decking, the liner typically is initially omitted from the track and the decking form can be supported within the track channel normally utilized for the liner bead. Such utilization is disclosed, for example, in my U.S. Pat. No. 4,574,017. Once the aggregate decking has set, the decking form is removed from the track and the liner bead is installed, positioned in its place. To assist in securing the liner within the track channel, a series of wedge-like locks of a type commercially available are inserted within the track in a force fit against the liner bead. For servicing or replacing the liner, the wedge-like locks can be removed, permitting the liner bead to be withdrawn.

Where it is preferred to insert the liner in place and fill or partially fill the pool with water prior to pouring the decking, the single channel track already containing the liner bead is rendered unsuitable for securing the aggregate form board. Under those circumstances, it has been common to utilize a liner track consisting of two superimposed parallel channels as disclosed for example in U.S. Pat. No. 4,457,119. The double channels permit the liner bead to be inserted and secured as described by wedging into the lower channel. The aggregate decking form board can then be secured into the upper channel, either before or after filling the pool with water. After the aggregate decking is poured and set, the form board is removed and the upper channel becomes available for other uses such as securing a pool cover during the winter months when the pool is not normally in use. Moreover, when the form board is positioned with the liner already in place, it has been the practice for the lower portion of the form board to be adhered directly to the liner surface with a known form of double sided adhesive tape. Unfortunately, removal of the form board tends to leave a residual quantity of tape gum on the liner. The unsightly gum can either be left in place or optionally removed by chemical solvents. The solvents, however, when applied also tend to remove the original coloring from the plastic liner. Either option detracts from the liner appearance and neither, therefore, is considered aesthetically satisfactory.

ASPECTS OF THE INVENTION

It is an aspect of the invention to provide an improved track for a liner-type in-ground swimming pool.

It is another aspect of the invention to provide an improved track as in the previous aspect, providing separate support for both the liner and decking form board so as to enable pouring the deck after the pool has been filled with water.

It is yet another aspect of the invention to provide the improved track of the previous aspects that affords a novel manner of liner retention and liner removal that is substantially enhanced as compared to similar purpose prior art track structures available for that purpose.

It is still another aspect of the invention to provide a method of adhering the form board directly onto the surface of the inplace liner in a manner permitting form board removal without adversely affecting the surface appearance of the liner.

SUMMARY OF THE INVENTION

This invention relates to an improved and novel track apparatus for use with liner-type in-ground swimming pools enabling liner placement before the associated decking is poured. More specifically, the invention relates to such a track apparatus affording an enhanced retention of the liner bead without the necessity of wedge locking the bead in the manner of the prior art. At the same time, the liner can be more readily removed for maintenance when required while the aggregate decking form can be placed in the track without regard to the presence of the liner therein.

In accordance with a preferred embodiment, the track of the invention extends secured about the pool perimeter and is formed of a separable two-component construction comprised of an elongated channeled body secured about the pool and an elongated channeled insert removably secured within the body. Both the body and insert are of plastic composition, preferrably PVC. The body defines a relatively large channel opening and is secured to a panel supported about the pool periphery. The insert is adapted to be received in a snap-in interfit within the body channel and when inserted in place, cooperates with the body to secure the liner bead against withdrawal. At the same time, the outwardly open channel of the insert positioned within the body can be utilized to secure the form board in place for pouring of the decking aggregate. Moreover, by adhesively mounting the form board directly against the liner utilizing a selected tape having a detergent soluble gum, any gum residue on the liner after the form board is removed can easily be removed from the liner without adverse affects on the liner appearance.

By virtue of the relative sectional configurations and interfit effected between the insert and body, the liner bead is positively secured without the necessity of a wedge lock in the manner of the prior art. Yet, the insert can be readily removed when removal of the liner becomes necessary for maintenance or replacement. At the same time, the channel defined by the emplaced insert provides for a secure, but removable retention of a received aggregate decking form mounted thereon.

The above-noted features and advantages of the invention as well as other superior aspects thereof, will be further appreciated by those skilled in the art upon reading the detailed description which follows in conjunction with the drawings.

DESCRIPTION OF THE PREFERRED EMBODIMENT

Figure 1:
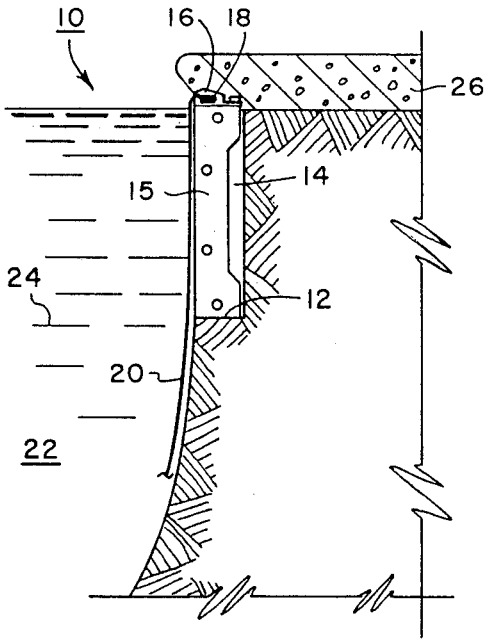
FIG. 1 (PRIOR ART)
FIG. 1 is a fragmentary sectional elevation of a typical prior art liner-type in-ground swimming pool utilizing a single channel liner track.

In the description which follows like parts are marked throughout the specification and drawings with the same reference numerals respectively. The drawing figures are not necessarily to scale and in certain views proportions may have been exaggerated for purposes of clarity.

Referring now to FIG. 1, there is illustrated a prior art construction of a liner-type swimming pool designated 10. Comprising the pool is a perimeter extending ground ledge 12 supporting contiguous sections of an upright panel 14 typically constructed of metal, wood or fiberglass secured at their ends by a bolt-up end plate 15. Secured to the top face of panel 14 is a single channel track 16, usually of plastic composition, and having a channel 17 (FIG. 2) in which the bead 18 of a pool liner 20 is wedge locked for securing the liner in position. From the track, the liner descends about the bowl 22 containing water fill 24. Formed above track 16 in a direction extending laterally away from bowl 22 is an aggregate decking 26, typically comprised of epoxy stone or concrete.

Figure 2:
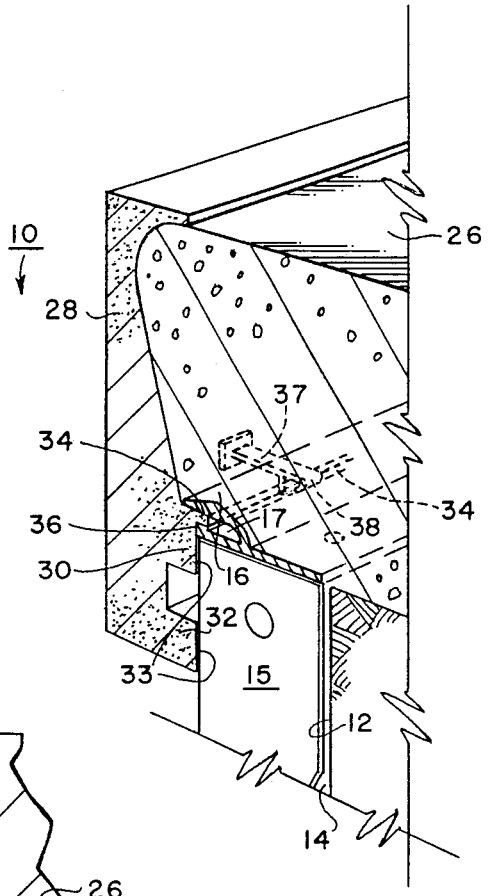
FIG. 2 (PRIOR ART)
FIG. 2 is an enlarged fragmentary isometric elevation illustrating the in-place aggregate form board for pouring the decking with the prior art track construction of FIG. 1.

For having formed the decking structure 26 of FIG. 1, there is illustrated in FIG. 2, an upright form board 28 having lower longitudinal feet 30 and 32, engaging a double sided adhesive tape 33 on the front face of panel 14. The integral laterally outward ledge 34 of form board 28 extends into channel 17 of track 16 to an extent defined by the position of track edge 36. As noted supra, form board 28 is typically comprised of a molded lightweight polystyrene composition and for these purposes includes a plurality of longitudinally spaced clips 37 embedded within the form at spacings of about every 6 inches. The distal end of the clip 37 includes a hook 38 which, when in place, effects a hook mounting over track edge 36. The form board remains positioned as illustrated in FIG. 2 until such time as the aggregate decking 26 has been poured and completely set, after which it can be easily removed from the relation shown. On removing the form board, any residual gum on panel 14 from tape 33 can, if desired, be removed by a chemical solvent.

Figure 3:
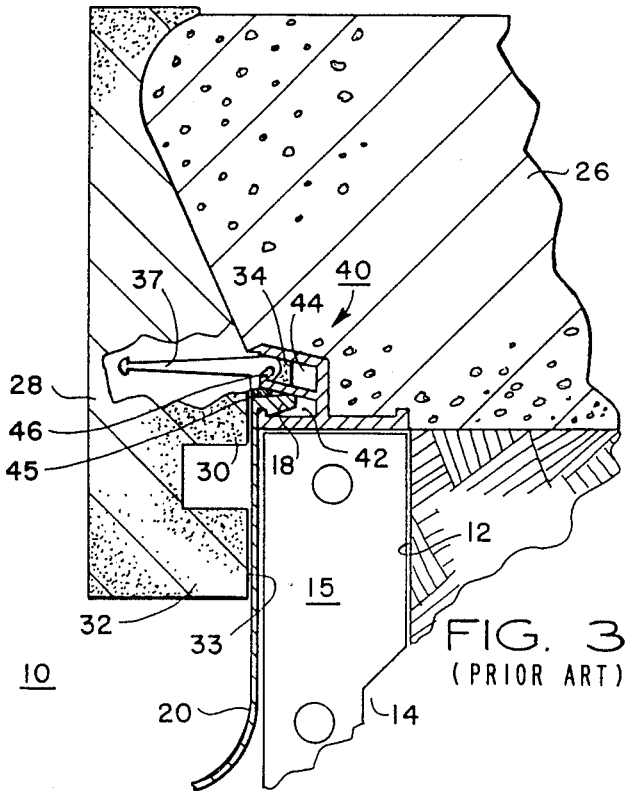
FIG. 3 (PRIOR ART)
FIG. 3 is a fragmentary sectional elevation of a prior art liner-type in-ground pool similar to FIG. 1 utilizing a double channel liner track.

As illustrated in FIG. 3, the prior art track 40 is comprised of an integrally molded plastic construction having a lower channel 42 and an upper channel 44. Liner bead 18 of liner 20 is folded over and inserted into the lower channel 42 where it is secured by a wedge lock 45 of a type commercially available. The upper channel 44 is available and can be utilized to receive form board ledge 34 inserted therein and supported as above. Clips 37, contained within the molded form 28 employ a hook 38 to hook or latch onto upright lip 46 of the upper channel 44. As before, the form board 28 remains positioned thereat throughout the pouring and setting stage of aggregate decking 26.

Whether utilizing the single channel track of FIGS. 1 and 2 or the double track of FIG. 3, bead 18 of liner 20 is secured within its recipient channel by means of an elongated wedge lock 45 that typically is forced to within the channel securely onto the bead. The prior art tracks 16 and 40 such as those described are typically of a polymer plastic composition. As explained, supra, the track of FIGS. 1 and 2 is only suitable when the water 24 is supplied to fill pool after the decking aggregate 26 has been poured and set. For the embodiment of FIG. 3, the specific sequence in which to fill pool 10 with water is immaterial. That is, filling the pool can be performed anytime after liner 20 is in place whether or not aggregate 26 has been poured since in this embodiment, upper channel 44 is always available for mounting the form board 28.

Figure 4:
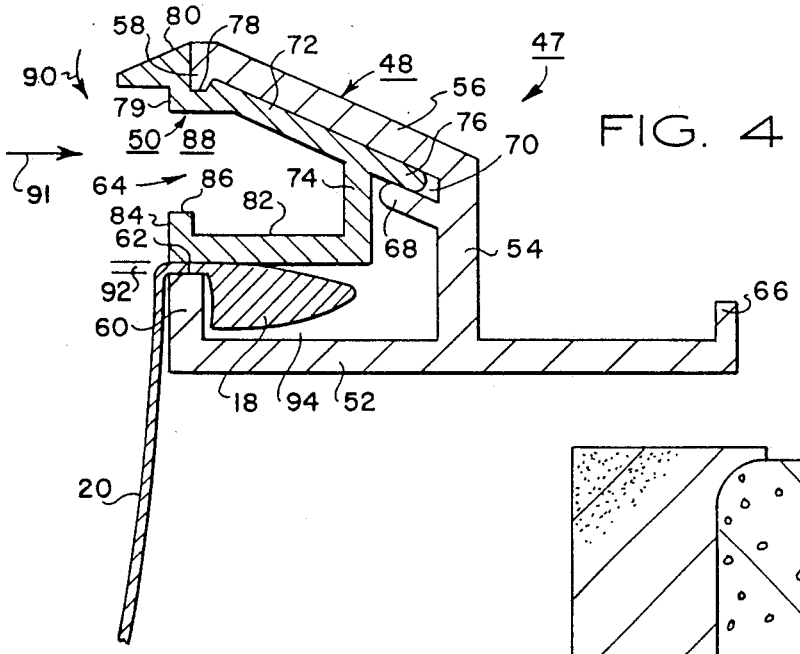
FIG. 4 is a sectional elevation of the liner track in accordance with the invention.
Figure 5:
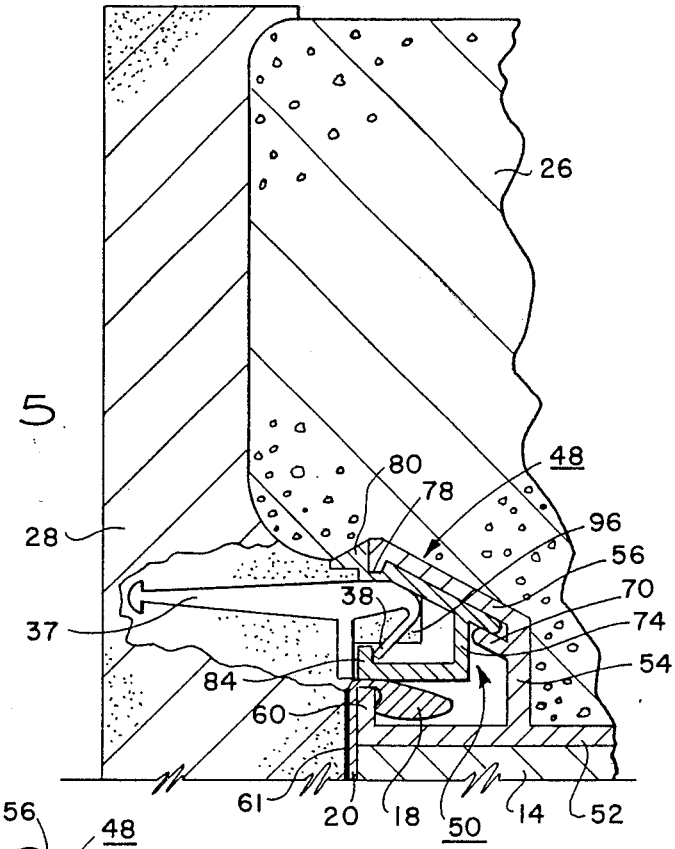
FIG. 5 is a fragmentary sectional elevation illustrating the track of FIG. 4 with the aggregate form board mounted thereon.
Figure 6:
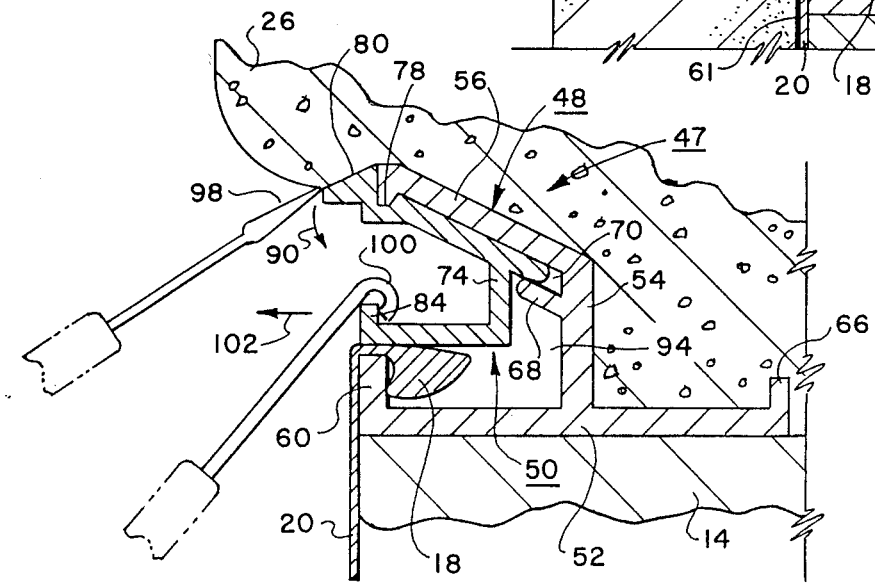
FIG. 6 is a fragmentary sectional elevation of the track of FIG. 5 illustrating removal of the pool liner.

Referring now to FIGS. 4-6, the track construction of the instant invention designated 47 is comprised of two components including a channel-like walled body section 48 and a relatively smaller channel-like walled body insert section 50 removably positioned within the body section. Both components are each integrally molded of rigid PVC and body section 48 is secured to panel 14 as above. Comprising the channel-like body section 48 is a bottom wall 52 extending between a front upright ledge 60 and a rear upright ledge 66. At an intermediate location, the bottom wall 52 intersects with a vertical rear wall 54. The rear wall, in turn, merges at its upper end with an upwardly sloping top wall 56, which at its front face, terminates in a downwardly depending front-lip 58. Partial upright wall 60 in the plane of lip 58 defines an edge 62 such that between the opposed faces of lip 58 and edge 62, there is defined an opening 64 through which insert 50 can be inserted and withdrawn.

Behind rear wall 54, the space intervening with lip 66 affords a pocket through which body 48 can be secured to panel 14 by bolts (not shown) and anchored by received aggregate decking 26. Extending integrally inward from the inner face of rear wall 54 is a relatively short lateral shelf 68. The shelf extends spaced from and generally parallel with the interior under face of top wall 56 to define a sloping pocket 70 therebetween for reasons as will be explained.

Insert 50 is adapted for insertion in and withdrawal from body 48 through body channel opening 64. Comprising insert 50 is a sloping top wall 72 of like angle as body wall 56 so as to effect a snug complementary fit therewith. Rearwardly, the top wall 72 intersects a vertical depending rear wall 74 and terminates beyond wall 74 in a tail section 76 receivable within body slot 70. At its forward face, top wall 72 includes a topside recess 78 in which to receive body lip 58 and terminates forward of a shoulder 79 in a downwardly sloping ledge 80. Integrally joined to the under edge of rear wall 74 is a bottom wall 82 integrally merging forward thereof with an upright ledge 84. Ledge 84 defines an upper edge face 86 which with the opposite spaced undersurface of top wall 72 defines a longitudinal channel opening 88 therebetween. It will be appreciated that the top wall 72 and bottom wall 82 about the opening 88 have a degree of resilient flexibility enabling them to be manually squeezed to a limited extent toward each other in the direction 90 for reasons as will be explained.

As specifically illustrated in FIG. 4, insert 50 is secured interfitted within body section 48 enabled by a front squeezing in the direction 90 and inserting the insert in the lateral direction 91 until tail 76 extends into slot 70 and recess 78 is positioned to receive lip 58. When released, the squeezed insert will snap into the interfit relation shown, rendering the insert tightly secured. When the interfit is effected in this manner, there is defined a narrow clearance 92 existing between the underside of insert bottom wall 82 and the topside edge 62 of body wall 60. Clearance 92 is typically on the order of about 1/32 inches and is sufficient for the thickness of liner 20 to extend without pinching or tearing so as to enable the liner bead 18 to be securely retained beyond the clearance in a body pocket 94 thereat captured against removal.

With liner 20 so secured, aggregate form board 28 can be positioned against a tape 61 previously positioned directly on liner 20 in the manner illustrated in FIG. 5. For this purpose, in order to avoid use of chemical solvents for subsequently removing any tape gum residue from the surface of liner 20, it is preferred to use a tape 61 having a gum removable with a detergent solution. Such a tape of a polypropylene composition is marketed as "tesapack 4287" by Tesa Corp. of West Germany. Lateral board ledge 96, in this relation, penetrates channel opening 88 sufficient for hook 38 of embodied clip 37 to hook onto the backside of upright wall ledge 84. After the aggregate 26 is poured and set, the form board 28 is easily removed as before leaving a completed decking 26 as illustrated in FIG. 6.

When necessary to replace or otherwise service liner 20, insert 50 can be removed from the interlocked interfit with body 48 by utilizing a screwdriver 98 and a hook 100. (FIG. 6). With the pool emptied and while the screwdriver imposes a downward force on ledge lip 80 in the direction 90 in order to displace recess 78 sufficiently clear of lip 58, the hook 100 grasping ledge 84 is withdrawn outwardly in the direction 102. After insert 50 is removed thereby, bead 18 is released, enabling the entire liner to be retrieved. At such time as reinsertment of the same or a replacement liner 20 is to be effected, the liner wall preceding bead 18 is placed overlying edge 62 sufficient for bead 18 to extend within the body pocket 94 thereat. Thereafter, by squeezing ledge 80 and bottom wall 82 toward each other in the direction 90, the insert 50 can be inserted in the direction 91 until tail section 76 is received in body slot 70 and recess 78 is positioned to receive lip 58. Releasing the squeeze effects a spring-like reversion and interlock to the relation illustrated causing insert 50 to remain seated and interlocked within the body 48. For a new installation or where decking 26 is to be refurbished, the form board 28 can be mounted or remounted in channel opening 88 so as to secure the form board as before.

By the above description, there is disclosed a novel construction of a two component track apparatus useful for both retaining the beaded edge of a swimming pool liner while enabling an aggregate form board to be inserted and supported during the pouring and setting of the pool decking. When the components are assembled, only a single channel track is provided by the insert and which channel is available for subsequent use. Unlike previous tracks employed for this purpose, a wedge lock to secure the liner bead is unnecessary and is in fact eliminated. At the same time the track apparatus is comprised of a relatively simple structure inexpensive to fabricate while enabling a most positive securement of the liner bead to be achieved. The virtues thereof are many, not least of which is the flexibility and simplicity by which the track construction hereof can be utilized on site for those instances where it is preferred to at least position the liner in place before the decking is poured. By utilizing a tape 61 having a detergent removable gum for supporting the form board, any residual gum remaining on the liner after removing the form board can be readily removed without deleteriously affecting the liner.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A track for retaining the beaded edge of a swimming pool liner comprising:

an elongated body section adapted for mounting about the perimeter of a swimming pool to be lined and having a channel-like sectional configuration orientated with its channel opening generally facing toward the pool; and insert means comprising a channel-like section removably insertable within said body section so as to be orientated with its channel opening generally facing toward the interior of the pool; said insert means being operative when disposed in said body section to cooperate with a body section surface thereat to define a relatively narrow clearance adapted for retaining a beaded edge of a pool liner against withdrawal while the channel opening of said insert means extends separated but substantially parallel to said clearance to be functionally independent of said liner retention and retains available for separate utilization.

2. A track in accordance with claim 1 in which said insert means when disposed in said body cooperates with a surface of said body to define said clearance therebetween through which said liner can extend for the beaded edge thereof to be retained inward beyond said clearance.

3. A track in accordance with claim 1 in which the channel opening of said insert means when disposed within the channel of said body section is adapted to removably retain a portion of a form board positioned thereat for the pouring of an aggregate decking about said track.

4. A track in accordance with claim 1 in which said insert means is configured at least partially complementary with the internal configuration of said body section such that when disposed within said body section is retained at least partially interfit within said body section.

5. A track in accordance with claim 4 in which said insert means is adapted to be secured in a snap-in mounting within said body section.

6. A track in accordance with claim 5 in which the walls defining the channel opening of said insert means are manually squeezable toward each other in a direction transverse to the direction of insertion to accommodate insertion and removable of said insert means to and from said body section.

7. A track in accordance with claim 6 in which each of said body section and said insert means is comprised of a polymer plastic composition.

8. An insert for an elongated channeled liner track having a body defining a channel with an opening thereinto and in which a beaded edge of a swimming pool liner is to be secured, said insert comprising:

an elongated channel-like means defining a channel insert section having an opening thereinto and sized and configured to be insertably received and secured within the channel of the liner track body with which the insert is to be utilized such that the body channel and insert channel openings are oriented in substantially the same direction; said channel-like means being operatively cooperative with the back body when disposed therein to define a relatively narrow clearance therebetween which the beaded edge of a received liner is retained while its opening extends separated but substantially parallel to said clearance to be functionally independent of said liner retention and remains available for separate utilization.

9. An insert in accordance with claim 8 including wall portions defining said insert channel means being configured to at least partially interfit within said body.

10. An insert in accordance with claim 9 in which said wall portions are sufficiently flexible to enable a squeezed insertion of the insert section into a snap-in mounting within said body.

11. An insert in accordance with claim 8 in which said insert section when disposed in said body cooperates with an opposing surface of said body to define said clearance therebetween through which a liner wall can extend while preventing withdrawal of the liner bead therethrough.

12. An insert in accordance with claim 11 in which said insert section when disposed in said body defines a single channel exposed for said separate utilization.

13. An insert in accordance with claim 8 in which the channel section of said insert when disposed in the track body is configured to receive a form board extension of an upright form board positioned thereat for the pouring of decking aggregate.

14. An insert in accordance with claim 13 in which said form board extension includes a hook means laterally protruding therefrom and said inset channel section includes means to receive said hook means in a hooked relation for maintaining the position of the positioned form board.

15. An insert in accordance with claim 8 in which said channel-like means is comprised of a polymer plastic composition.

* * * * *